US010818243B2

(12) United States Patent
Chen et al.

(10) Patent No.: US 10,818,243 B2
(45) Date of Patent: Oct. 27, 2020

(54) DRIVE METHOD FOR ORGANIC LIGHT-EMITTING DISPLAY BY CONTROLLING GIP SIGNAL AND DATA SIGNAL

(71) Applicant: KUNSHAN GO-VISIONOX OPTO-ELECTRONICS CO., LTD., Jiangsu (CN)

(72) Inventors: Xinquan Chen, Jiangsu (CN); Xiangqian Wang, Jiangsu (CN); Mingwei Ge, Jiangsu (CN); Zheng Wang, Jiangsu (CN); Xiujian Zhu, Jiangsu (CN)

(73) Assignee: Kunshan Go-Visionox Opto-Electronics Co., Ltd., Jiangsu (CN)

( * ) Notice: Subject to any disclaimer, the term of this patent is extended or adjusted under 35 U.S.C. 154(b) by 0 days.

(21) Appl. No.: 16/318,541

(22) PCT Filed: Mar. 7, 2018

(86) PCT No.: PCT/CN2018/078273
§ 371 (c)(1),
(2) Date: Jan. 17, 2019

(87) PCT Pub. No.: WO2018/171428
PCT Pub. Date: Sep. 27, 2018

(65) Prior Publication Data

US 2019/0237024 A1 Aug. 1, 2019

(30) Foreign Application Priority Data

Mar. 21, 2017 (CN) ..... 2017 1 0170695

(51) Int. Cl.
*G09G 3/3266* (2016.01)

(52) U.S. Cl.
CPC ... *G09G 3/3266* (2013.01); *G09G 2310/0245* (2013.01); *G09G 2320/0247* (2013.01); *G09G 2330/026* (2013.01); *G09G 2330/028* (2013.01)

(58) Field of Classification Search
None
See application file for complete search history.

(56) References Cited

U.S. PATENT DOCUMENTS

2004/0174349 A1* 9/2004 Libsch ..... G09G 3/3233 345/204
2012/0019569 A1 1/2012 Byun
(Continued)

FOREIGN PATENT DOCUMENTS

CN 1588528 A 3/2005
CN 1588529 A 3/2005
(Continued)

*Primary Examiner* — Chad M Dicke
(74) *Attorney, Agent, or Firm* — Muncy, Geissler, Olds & Lowe, P.C.

(57) ABSTRACT

A method for driving an organic light-emitting display includes controlling a GIP signal and a data signal during a bootup process of the organic light-emitting display to enable the organic light-emitting display to sequentially pass through an initialization state, a black state, and a normal display state, to prevent a screen flicker problem of the organic light-emitting display during booting.

6 Claims, 2 Drawing Sheets

(56) References Cited

U.S. PATENT DOCUMENTS

| | | | | |
|---|---|---|---|---|
| 2012/0161637 | A1* | 6/2012 | Lee | G09G 3/32 315/122 |
| 2013/0082910 | A1* | 4/2013 | Lee | G09G 3/3208 345/76 |
| 2014/0285413 | A1 | 9/2014 | Miyatake et al. | |
| 2016/0117979 | A1 | 4/2016 | An et al. | |
| 2017/0069264 | A1* | 3/2017 | Dai | G09G 3/3233 |
| 2017/0124954 | A1* | 5/2017 | Park | G09G 3/3258 |
| 2019/0066597 | A1* | 2/2019 | Lan | G09G 3/3266 |
| 2019/0237024 | A1* | 8/2019 | Chen | G09G 3/3266 |

FOREIGN PATENT DOCUMENTS

| | | | |
|---|---|---|---|
| CN | 101515441 | A | 8/2009 |
| CN | 101646029 | A | 2/2010 |
| CN | 102542983 | A | 7/2012 |
| CN | 102708784 | A | 10/2012 |
| CN | 102842292 | A | 12/2012 |
| CN | 104916263 | A | 9/2015 |
| CN | 105185293 | A | 12/2015 |
| CN | 105185304 | A | 12/2015 |
| CN | 105469768 | A | 4/2016 |
| CN | 105702211 | A | 6/2016 |
| CN | 106710523 | A | 5/2017 |
| JP | 2000305522 | A | 11/2000 |
| JP | 2001086401 | A | 3/2001 |
| JP | 2005062618 | A | 3/2005 |
| JP | 2005338494 | A | 12/2005 |
| JP | 2006146022 | A | 6/2006 |
| JP | 2007114476 | A | 5/2007 |
| JP | 2011013415 | A | 1/2011 |
| KR | 20120070974 | A | 7/2012 |
| TW | 200743093 | A | 11/2007 |
| TW | 200818086 | A | 4/2008 |
| TW | 201115216 | A | 5/2011 |

* cited by examiner

DRIVE METHOD FOR ORGANIC LIGHT-EMITTING DISPLAY BY CONTROLLING GIP SIGNAL AND DATA SIGNAL

TECHNICAL FIELD

The present invention relates to the field of flat panel display technology, and in particular, to a method for driving an organic light-emitting display.

TECHNICAL BACKGROUND

An Organic Light-emitting Display (abbr. OLED) is an active light-emitting device. Compared with the Thin Film Transistor liquid crystal display (abbr. TFT-LCD) of mainstream flat panel display technology, the OLED has advantages of high contrast, wide viewing angle, low power consumption and thinner volume, and therefore is likely to become a next-generation flat panel display technology after the TFT-LCD and become one of the technologies drawing most attention in the current flat panel display technologies.

An organic light-emitting display usually includes a display panel and a display circuit connected to the display panel, where the display circuit is configured to drive the display panel to display an image. During actual manufacturing and usage, a problem of screen flicker (splash screen) is likely to occur in the boot screen due to the residual charges contained in the display panel. At present, the problem of splash screen of organic light-emitting displays occurs in a high proportion, severely affecting the yield of products.

Hence, in current industry, the GIP (Gate in Panel) signal output from the drive circuit to the display panel is usually configured to different levels to initialize the screen body before the display panel is normally lighted up. However, a fixed level is continuously attenuated in cascaded drive circuits, resulting in the disappearance of initialization effect after the GIP signal has transmitted for several rows. Therefore, the problem of splash screen of organic light-emitting displays still occurs in a high proportion.

Based on this, it is an urgent technical problem to be solved by those skilled in the art to address the splash screen issue when booting an existing organic light-emitting display.

SUMMARY

It is an object of the present invention to provide a method for driving an organic light-emitting display to solve the problem of splash screen occurred when booting an existing organic light-emitting display.

To solve the foregoing problem, the present invention provides a method for driving an organic light-emitting display, comprising controlling a GIP signal and a data signal provided to a plurality of pixels of the organic light-emitting display during bootup, to enable the organic light-emitting display to sequentially pass through an initialization state, a black state, and a normal display state.

Optionally, in the method for driving an organic light-emitting display, a bootup process of the organic light-emitting display sequentially comprises a first preset time period, a second preset time period, and a third preset time period;

in the first preset time period, the data signal is set to a high-impedance state, and the GIP signal is set to a normal output state;

in the second preset time period, the data signal is set to a black state, and the GIP signal is kept in the normal output state; and in the third preset time period, the data signal is set to a normal display state, and the GIP signal is kept in the normal output state.

Optionally, in the method for driving an organic light-emitting display, a pixel positive voltage and a pixel negative voltage are provided to a plurality of pixels in the second preset time period.

Optionally in the method for driving an organic light-emitting display, each of the first preset time period, the second preset time period, and the third preset time period is longer than a duration of one frame.

Optionally, in the method for driving an organic light-emitting display, a bootup process of the organic light-emitting display sequentially comprises a first preset time period, a second preset time period, and a third preset time period;

in the first preset time period, the data signal is set to a black state, and the GIP signal is set to a specific state;

in the second preset time period, the data signal is kept in the black state, and the GIP signal is set to a normal output state; and in the third preset time period, the data signal is set to a normal display state, and the GIP signal is kept in the normal output state.

Optionally, in the method for driving an organic light-emitting display, a pixel positive voltage and a pixel negative voltage are provided to a plurality of pixels in the second preset time period.

Optionally, in the method for driving an organic light-emitting display, each of the first preset time period, the second preset time period, and the third preset time period is longer than a duration of one frame.

Optionally, in the method for driving an organic light-emitting display, a bootup process of the organic light-emitting display sequentially comprises a first preset time period, a second preset time period, and a third preset time period;

in the first preset time period, the data signal is set to 0 V, and the GIP signal is set to a normal output state;

in the second preset time period, the data signal is kept in the black state, and the GIP signal is kept in the normal output state; and in the third preset time period, the data signal is set to a normal display state, and the GIP signal is kept in the normal output state.

Optionally, in the method for driving an organic light-emitting display, a pixel positive voltage and a pixel negative voltage are provided to a plurality of pixels in the second preset time period.

Optionally, in the method for driving an organic light-emitting display, each of the first preset time period, the second preset time period, and the third preset time period is longer than a duration of one frame.

In the method for driving an organic light-emitting display provided in the present invention, the GIP signal and the data signal are controlled during the first preset time period of bootup to initialize a screen body, and the data signal is set to the black state in the second preset time period, thus avoiding the occurrence of splash screen issue when booting the organic light-emitting display.

DETAILED DESCRIPTION OF EMBODIMENTS

A method for driving an organic light-emitting display provided in the present invention is described below in more detail with reference to the accompanying drawings and specific embodiments. The advantages and features of the present invention will be more apparent from the following descriptions and claims. It should be noted that the accompanying drawings are presented in a simplified form not precisely drawn to scale with the only purpose of facilitating the description of the embodiments of the present invention.

Embodiment 1

Figure 1:
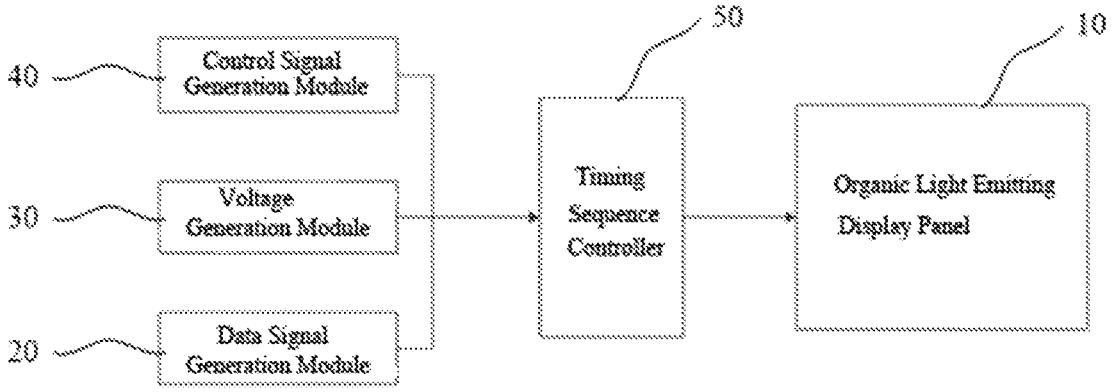
FIG. 1 is a schematic structural diagram of an organic light-emitting display according to Embodiment 1 of the present invention.

Referring to FIG. 1, which is a schematic structural diagram of an organic light-emitting display according to embodiments of the present invention. As shown in FIG. 1, the organic light-emitting display 10 includes an organic light-emitting display panel 10 having a plurality of pixels and a GIP circuit (not shown) providing GIP signals (or scan signals) to the plurality of pixels. The organic light-emitting display 10 includes a data signal generation module 20 providing data signals to the plurality of pixels. The organic light-emitting display 10 includes a voltage generation module 30 providing voltage signals to the plurality of pixels and the GIP circuit respectively. The organic light-emitting display 10 includes a control signal generation module 40 providing control signals to the voltage generation module 30 and the GIP circuit respectively. The organic light-emitting display 10 includes a timing controller 50. The data signal generation module 20, the voltage generation module 30, and the control signal generation module 40 are all connected to the organic light-emitting display panel 10 through the timing controller 50 which controls timing sequence of outputting the scan signals, the data signals, the voltage signals, and the control signals to the organic light-emitting display panel 10.

Specifically, the organic light-emitting display panel 10 includes a plurality of pixels arranged in a matrix and a GIP circuit (not shown in the figure) generating and outputting multiple stages of GIP signals (i.e., scan signals). The plurality of pixels arranged in a matrix are connected to the GIP circuit and are gated according to the scan signals provided by the GIP circuit.

When the voltage signal needed by the GIP circuit are provided to the GIP circuit by the voltage generation module 30, an initial signal needed by the GIP circuit are provided to the GIP circuit by the control signal generation module 40. The GIP circuit begins to generate and output multiple stages of GIP signals. Usually, the first stage GIP signal is provided to the scan line of the pixels in the first row, and the pixels in the first row are gated according to the first stage GIP signal. The second stage GIP signal is provided to the scan line of the pixels in the second row, and the pixels in the second row are gated according to the second stage GIP signal. By analogy, the $n^{th}$ stage GIP signal is provided to the scan line of the pixels in the $n^{th}$ row, and the pixels in the $n^{th}$ row are gated according to the $n^{th}$ stage GIP signal, where n is a natural number.

Figure 2:
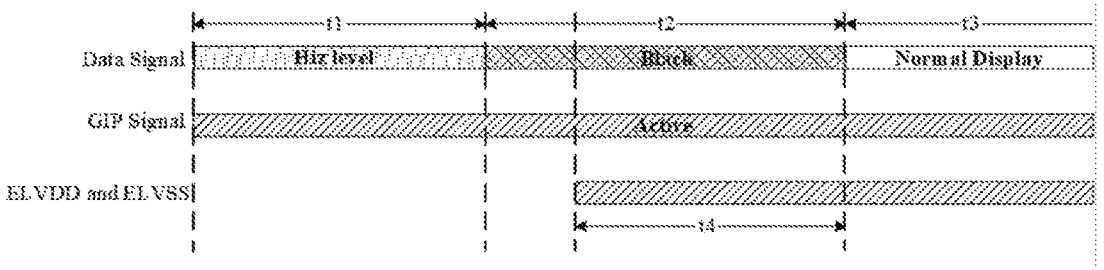
FIG. 2 is a schematic diagram of respective signals in a method for driving an organic light-emitting display according to Embodiment 1 of the present invention.
Figure 3:
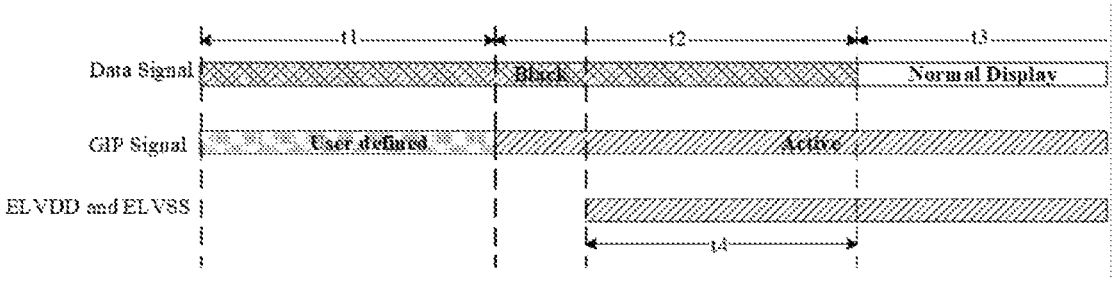
FIG. 3 is a schematic diagram of respective signals in a method for driving an organic light-emitting display according to Embodiment 2 of the present invention.
Figure 4:
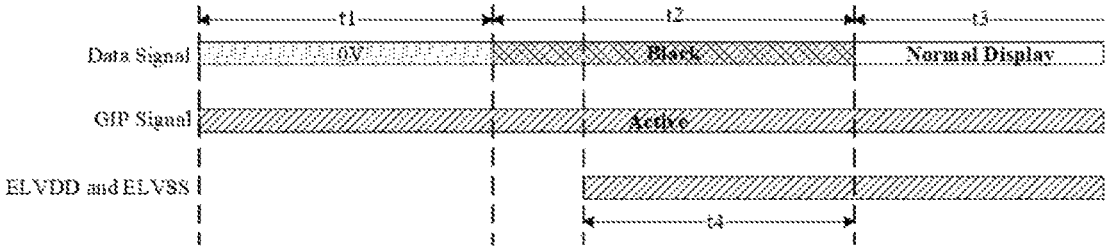
FIG. 4 is a schematic diagram of respective signals in a method for driving an organic light-emitting display according to Embodiment 3 of the present invention.

The data signal generation module 20 is configured to generate and output data signals (i.e., source signals in FIG. 2 to FIG. 4). When the pixels of the organic light-emitting display panel 10 is gated, if the data signal provided by the data signal generation module 20 is received, an image is displayed according to the data signal.

The voltage generation module 30 is configured to generate and output a voltage signal including a voltage signal needed by the pixel and a voltage signal needed by the GIP circuit. The voltage signal needed by the pixel includes a pixel positive voltage ELVDD and a pixel negative voltage ELVSS. The voltage signal needed by the GIP circuit includes a GIP circuit positive voltage and a GIP circuit negative voltage.

The control signal generation module 40 is configured to generate and output a control signal including an initial signal needed by the GIP circuit and a voltage control signal for controlling the voltage signal. The voltage generation module 30 generates and outputs the pixel positive voltage ELVDD and the pixel negative voltage ELVSS when the voltage control signal is received.

Referring to FIG. 1 and FIG. 2, the method for driving an organic light-emitting display includes:

a bootup process sequentially including a first preset time period t1 (an initialization state), a second preset time period t2 (a black state), and a third preset time period t3 (a normal display state).

In the first preset time period t1, a data signal is set to a high-impedance state (Hiz level), and at the same time, a GIP signal is set to a normal output state (Active).

In the second preset time period t2, the data signal is set to a black state (Black) and the GIP signal is kept in the normal output state (Active).

In the third preset time period t3, the data signal is set to a normal display state (Normal Display) and the GIP signal is kept in the normal output state (Active).

Specifically, the data signal generated and output by the data signal generation module 20 is in the high-impedance state (Hiz level) in the first preset time period t1, is in the black state (Black) in the second preset time period t2, and is in the normal display state (Normal Display) in the third preset time period t3. The GIP signal provided by the GIP circuit keeps in the normal output state (Active) from the first preset time period t1 to the third preset time period t3. The voltage control signal is output in the second preset time period t2 by the control signal generation module 40, and the pixel positive voltage ELVDD and the pixel negative voltage ELVSS are generated by the voltage generation module 30. That is, after the high-impedance state (Hiz level) of the data signal ends, the pixel positive voltage ELVDD and the pixel negative voltage ELVSS are provided to a pixel of the organic light-emitting display panel 10.

Preferably, the time period (t4) from starting to provide the voltage signal of the pixel to the end of the second preset time period last a duration of at least one frame. Before the third preset time period t3 (i.e., the normal display), due to the time period of applying the voltage signal of the pixel to the pixel lasting a duration of at least one frame, the voltage signal of the pixel is already stable to enable the pixel to stably emit light in the third preset time period t3.

In this embodiment, each of the first preset time period t1, the second preset time period t2, and the third preset time period t3 is longer than a duration of one frame. t4 may be less than or equal to t2 and greater than or equal to a duration of one frame.

In this embodiment, the first preset time period t1 is the initialization state. During the first preset time period, the GIP signal in the normal output state (Active) and the data signal in the high-impedance state (Hiz level) are provided to the pixel for a duration of at least one frame, thus a screen body is initialized. The second preset time period is a preset screen (black screen) display phase. During the second preset time period, the data signal is set to the black state (Black), thus splash screen problem could be prevented when the voltage signal (including the pixel positive voltage ELVDD and the pixel negative voltage ELVSS) is provided to the pixel. The third preset time period t3 is the normal display state.

Embodiment 2

Correspondingly, the present invention further provides a method for driving an organic light-emitting display. Referring to FIG. 1 and FIG. 3, the method for driving an organic light-emitting display includes:

a bootup process sequentially including a first preset time period t1 (an initialization state), a second preset time period t2 (a black state), and a third preset time period t3 (a normal display state).

In the first preset time period t1, a data signal is set to a black state (Black), and a GIP signal is set to a specific state (User defined).

In the second preset time period t2, the data signal is in the black state (Black), and the GIP signal being set to a normal output state (Active).

In the third preset time period t3, the data signal is set to a normal display state (Normal Display), and the GIP signal is kept in the normal output state (Active).

Specifically, the data signal generated and output by the data signal generation module 20 is in the black state (Black) in both of the first preset time period t1 and the second preset time period t2, and is in the normal display state (Normal Display) in the third preset time period t3. The GIP signal provided by the GIP circuit is in the specific state (User defined) in the first preset time period t1, and is still kept in the normal output state (Active) in the second preset time period t2 and the third preset time period t3. The voltage control signal in the second preset time period t2 is output by the control signal generation module 40. The pixel positive voltage ELVDD and the pixel negative voltage ELVSS is generated and output by the voltage generation module 30. That is, after the specific state (User defined) of the GIP signal ends, the pixel positive voltage ELVDD and the pixel negative voltage ELVSS are provided to the pixel.

The specific state (User defined) refers to selecting a specific input clock signal (GIP input clock) according to an EM circuit architecture of the GIP circuit, so as to keep a high level output by the light emission control signal (EM signal).

Preferably, the time period (t4) from starting to provide the voltage signal of the pixel to the end of the second preset time period last a duration of at least one frame. Before the third preset time period t3 (i.e., normal display), due to the time period of applying the voltage signal of the pixel to the pixel lasting a duration of at least one frame, the voltage signal of the pixel is already stable, thus to enable the pixel to stably emit light in the third preset time period t3.

In this embodiment, each of the first preset time period t1, the second preset time period t2, and the third preset time period t3 is longer than a duration of one frame. t4 may be less than or equal to t2 and greater than or equal to a duration of one frame.

In this embodiment, the first preset time period t1 is the initialization state. During the first preset time period, the GIP signal in the specific state (user defined) and the data signal in the black state (Black) provided to the pixel lasts a duration of at least one frame, thus a screen body is initialized. The second preset time period is a preset screen (black screen) display phase. During the second preset time period, the data signal is set to the black state (Black), thus splash screen problem could be prevented when the voltage signal (including the pixel positive voltage ELVDD and the pixel negative voltage ELVSS) is provided to the pixel. The third preset time period t3 is kept in the normal display state.

Embodiment 3

Correspondingly, the present invention further provides another method for driving an organic light-emitting display. Referring to FIG. 1 and FIG. 4, the method for driving an organic light-emitting display includes:

a bootup process sequentially including a first preset time period t1 (an initialization state), a second preset time period t2 (a black state), and a third preset time period t3 (a normal display state).

In the first preset time period t1, a data signal is set to 0 V, and a GIP signal is set to a normal output state (Active).

In the second preset time period t2, the data signal is kept in the black state (Black), and the GIP signal is set in the normal output state (Active).

In the third preset time period t3, the data signal is set to a normal display state (Normal Display), and the GIP signal is kept in the normal output state (Active).

Specifically, the data signal generated and output by the data signal generation module 20 is 0 V in the first preset time period t1, is in the black state (Black) in the second preset time period t2, and is in the normal display state (Normal Display) in the third preset time period t3. The GIP signal provided by the GIP circuit is still in the normal output state (Active) from the first preset time period t1 to the third preset time period t3. The voltage control signal in the second preset time period t2 is output by the control signal generation module 40, and the pixel positive voltage ELVDD and the pixel negative voltage ELVSS is generated and output by the voltage generation module 30. That is, after the data signal of 0 V ends, the pixel positive voltage ELVDD and the pixel negative voltage ELVSS are provided to the pixel.

Preferably, the time period (t4) from starting to provide the voltage signal of the pixel to the end of the second preset time period last a duration of at least one frame. Before the third preset time period t3 (i.e., the normal display), due to the time period of applying the voltage signal of the pixel to the pixel lasting a duration of at least one frame, the voltage signal of the pixel is already stable at this moment, thus to enable the pixel to stably emit light in the third preset time period t3.

In this embodiment, each of the first preset time period t1, the second preset time period t2, and the third preset time period t3 is longer than a duration of one frame. t4 may be less than or equal to t2 and greater than or equal to a duration of one frame.

In this embodiment, the first preset time period t1 is the initialization state of bootup. During the first preset time period, the GIP signal in the normal output state (Active) and the data signal of 0 V provided to the pixel lasts a duration of at least one frame, thus a screen body is initialized. The second preset time period is a preset screen (black screen) display phase of bootup. During the second preset time period, the data signal is set to the black state (Black), thus splash screen problem could be prevented when the voltage signal (including the pixel positive voltage ELVDD and the pixel negative voltage ELVSS) are provided to the pixel. The third preset time period t3 is the normal display state.

In conclusion, in the method for driving an organic light-emitting display provided in the present invention, the GIP signal and the data signal are controlled during the first preset time period of bootup to initialize a screen body, and the second preset time period is set to the black state, thus avoiding the occurrence of the splash screen problem when booting the organic light-emitting display.

The foregoing description is merely preferred embodiments of the present invention and does not limit the scope of the present invention in any way. Any changes or modifications made by those of ordinary skilled in the art concerning the foregoing disclosure fall within the protection scope of the appended claims.

What is claimed is:

1. A method for driving an organic light-emitting display, a bootup process of the organic light-emitting display sequentially comprising a first preset time period, a second preset time period, and a third preset time period, wherein the method comprises controlling a GIP (Gate in Panel) signal and a data signal that are continuously provided to a plurality of pixels of the organic light-emitting display from a start of the first preset time period, through the second preset time period, to an end of the third preset time period, so as to enable the organic light-emitting display to sequentially pass through an initialization state, a black state, and a normal display state, wherein the organic light-emitting display is initialized during the first preset time period, and wherein a pixel positive voltage and a pixel negative voltage are provided to a plurality of pixels in the second preset time period, wherein, in the first preset time period, the data signal is set to a high-impedance state, and the GIP signal is set to an active output state;

in the second preset time period, the data signal is set to a black state, and the GIP signal is kept in the active output state; and in the third preset time period, the data signal is set to a normal display state, and the GIP signal is kept in the active output state.

2. The method for driving an organic light-emitting display according to claim 1, wherein each of the first preset time period, the second preset time period and the third preset time period is longer than a duration of one frame.

3. The method for driving an organic light-emitting display according to claim 1, wherein the pixel positive voltage and the pixel negative voltage start to be provided to the plurality of pixels in the second preset time period simultaneously.

4. A method for driving an organic light-emitting display, a bootup process of the organic light-emitting display sequentially comprising a first preset time period, a second preset time period, and a third preset time period, wherein the method comprises controlling a GIP (Gate in Panel) signal and a data signal that are continuously provided to a plurality of pixels of the organic light-emitting display from a start of the first preset time period, through the second preset time period, to an end of the third preset time period, so as to enable the organic light-emitting display to sequentially pass through an initialization state, a black state, and a normal display state, wherein the organic light-emitting display is initialized during the first preset time period, wherein a pixel positive voltage and a pixel negative voltage are provided to a plurality of pixels in the second preset time period, wherein in the first preset time period, the data signal is set to 0 V, and the GIP signal is set to an active output state;

in the second preset time period, the data signal is set in the black state, and the GIP signal is kept in the active output state; and in the third preset time period, the data signal is set to a normal display state, and the GIP signal is kept in the active output state.

5. The method for driving an organic light-emitting display according to claim 4, wherein each of the first preset time period, the second preset time period, and the third preset time period is longer than a duration of one frame.

6. The method for driving an organic light-emitting display according to claim 4, wherein the pixel positive voltage and the pixel negative voltage start to be provided to the plurality of pixels in the second preset time period simultaneously.

* * * * *